US005593810A

United States Patent [19]

Lindholm et al.

[11] Patent Number: 5,593,810

[45] Date of Patent: Jan. 14, 1997

[54] DIFFUSION TRANSFER FILM UNIT

[75] Inventors: Edward P. Lindholm, Brookline; James J. Manning, Braintree, both of Mass.

[73] Assignee: Polaroid Corporation, Cambridge, Mass.

[21] Appl. No.: 645,803

[22] Filed: May 14, 1996

[51] Int. Cl.[6] ..... G03C 8/54

[52] U.S. Cl. ..... 430/213; 430/215; 430/227

[58] Field of Search ..... 430/213, 215, 430/227, 232, 230, 217

[56] References Cited

U.S. PATENT DOCUMENTS

| | | | |
|---|---|---|---|
| 3,362,819 | 1/1968 | Land | 430/215 |
| 3,421,893 | 1/1969 | Taylor | 430/215 |
| 4,108,814 | 8/1978 | Reiff et al. | 260/29.2 TN |
| 4,237,264 | 12/1980 | Noll et al. | 528/67 |
| 4,391,895 | 7/1983 | Schwarzel et al. | 430/215 |
| 4,408,008 | 10/1983 | Markusch | 524/591 |
| 4,902,593 | 2/1990 | Vermeulen et al. | 430/215 |
| 4,908,286 | 3/1990 | Vervloet et al. | 430/232 |

*Primary Examiner*—Richard L. Schilling
*Attorney, Agent, or Firm*—Jennifer A. Kispert

[57] ABSTRACT

There is described a novel diffusion transfer film unit for use in a diffusion transfer photographic system which includes a layer comprising a polyester ufethane polymer(s) which is inert to alkali, and specifically, a layer which exhibits permeability to alkali inversely dependent upon temperature. Diffusion transfer photographic systems utilizing the diffusion transfer film unit of the present invention exhibit superior hot temperature processing.

22 Claims, No Drawings

DIFFUSION TRANSFER FILM UNIT

This invention relates to a novel diffusion transfer film unit for use in a diffusion transfer photographic system which includes a layer, e.g., a time modulating diffusion control layer (timing layer) or a diffusion control interlayer, which exhibits permeability to alkali inversely dependent upon temperature, and specifically, to a layer which provides superior hot temperature processing, for example, processing at a temperature in the order of 35° C.

BACKGROUND OF THE INVENTION

Diffusion transfer photographic processes are well known in the art. Such processes have in common the feature that the final image is a function of the formation of an imagewise distribution of an image-providing material and the diffusion transfer of the imagewise distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image dye-providing material, and transferring this imagewise distribution by diffusion to a superposed image-receiving layer of an image-receiving element, or positive film component, to impart a transfer image thereto.

The aqueous processing compositions employed in diffusion transfer processes are usually highly alkaline (e.g., pH>12). After processing has been allowed to proceed for a predetermined period of time, it is desirable to neutralize the alkali of the processing composition to prevent further development and image dye transfer, and, in some instances, subsequent oxidation which may have a material and substantial effect upon the stability to light of the resulting image in the image-receiving layer.

Accordingly, a neutralizing layer, typically a nondiffusible acid-reacting reagent, is employed in the film unit to lower the pH from a first (high) pH of the processing composition to a predetermined second (lower) pH. For example, a polymeric acid neutralizing layer can be used such as disclosed in U.S. Pat. Nos. 3,362,819 and 3,415,644. Generally, the polymeric acid comprises a polymer containing acid groups, typically carboxy groups, which are capable of forming salts with alkali metals such as sodium or potassium which are usually included in the processing composition. In order to ensure that the pH reduction occurs after a sufficient, predetermined period and not prematurely so as to interfere with the development process, a timing layer is typically positioned before the neutralization layer.

Timing layers have been designed to operate in a number of ways including: (1) as a sieve which slowly meters the flow of alkali therethrough to the polymeric acid neutralizing layer as described in aforementioned U.S. Pat. No. 3,362,819 and in U.S. Pat. No. 3,421,893 ("sieve-type") and (2) as an alkali-impermeable barrier for a predetermined time interval before converting in a rapid and quantitatively substantial fashion to a relatively alkali-permeable condition, upon the occurrence of a predetermined chemical reaction, e.g., hydrolysis and beta-elimination, under basic conditions and known in the art as "hold and release," as disclosed in U.S. Pat. Nos. 3,575,701; 4,201,587; 4,288,523; 4,297,431; 4,391,895; 4,426,481; 4,458,001; 4,461,824 and 4,457,451.

Generally, an additional factor to be considered with regard to designing a timing layer possessing optimum alkali-permeability characteristics within the temperature range of optimum transfer processing is that the rate of the development process involved in diffusion transfer photography is temperature-dependent, i.e., at reduced temperatures, the development process becomes markedly slower; at higher temperatures, the rate of development is increased.

Accordingly, such a range of development rates imposes additional performance demands on the timing layer. More specifically, if a timing layer were to permit penetration by alkali to the neutralizing layer while development were still incomplete because of a low temperature slow-down of the development process, development shut-down would be premature and image formation would be incomplete. Similarly, at increased development rates resulting from the effects of higher temperatures, late release by a timing layer could cause over-development, producing images of reduced dye density. Therefore, to avoid the side effects of temperature variations, the timing layers have been typically designed to offer a temperature response substantially parallel to that of the development process, i.e., the permeability to alkali is directly dependent upon temperature.

However, as disclosed in aforementioned U.S. Pat. No. 3,421,893, "sieve-type" timing layers may also comprise materials exhibiting permeability to alkali which is inversely dependent upon temperature, i.e., temperature-inverting polyvinyl amides which exhibit superior cold temperature processing. More particularly, aforementioned U.S. Pat. No. 3,421,893 describes a timing layer which as a whole exhibits temperature inverting properties which enable it to assert a better measure of control over the polymeric acid neutralizing layer at cold temperatures, e.g., 10° C., than would a non-temperature inverting timing layer which typically shows decreased permeability as the temperature is reduced to, e.g., 10° C. As stated earlier, in this situation, the use of a non-temperature inverting timing layer could result in the maintenance of the transfer processing environment's high pH for such an extended time interval as to facilitate formation of transfer image stain and its resultant degradation of the positive transfer image's color definition.

Benefits are derived from using a temperature-inverting material in a process, e.g., the development of an exposed photosensitive photographic film unit, which depends upon permeation of liquids at a variety of temperatures. For example, as the ambient temperature decreases, the temperature inverting, e.g., polymeric, material of the timing layer tends to form hydrates and swells, thus facilitating permeation as function of the degree of swell of the polymer—deswelling being inherent with an increase in temperature. Further, it is well known that the diffusion rate of a liquid, e.g., an alkali, will increase as the temperature increases and that, in a typical diffusion transfer photographic process this rate is directly proportional to the progress of the transfer image formation per unit time. Hence, the benefit of devising a mechanism for controlling the diffusion rate inversely with temperature is recognized. Moreover, the desired result is to have the temperature inverting material approximately counteract changes in the diffusion rate of the permeating material with changes in temperature. Temperature inversion is, therefore, relative, since the precise properties desired would be dependent upon the response of the whole, e.g., photographic system, to changes in temperature.

Furthermore, extreme inverse temperature characteristics are generally not particularly desirable since the development of the photosensitive element of the system and the dye transfer are temperature dependent processes and should be functionally compatible with the temperature-permeation properties of the image-receiving element. Therefore, an ideal timing layer should provide the system which it comprises with the proper dye permeation-temperature properties so that the dye(s) may diffuse from the photosensitive element to the image-receiving element as a function of development to form a positive image in the image-receiving layer within a predetermined time, irrespective of the processing temperature employed.

It is thought by those of ordinary skill in the art that the temperature inverting properties possessed by certain materials may be attributable to the presence of a predetermined balance of hydrophobic groups to hydrophilic groups in the, e.g., polymer molecule. It is also thought that a probable mechanism through which temperature inversion occurs is by the formation of hydrogen bonds between the hydrophilic portion of the, e.g., polymer, and the hydrogen of the solvent at low temperatures; the hydrogen bonding being discouraged as the temperature of the material is raised due to thermal destruction. The system thereupon takes the form of a less hydrated, less-swollen, therefore, less-permeable, e.g., polymer, as a function of the increase in temperature. However, it is important to remember that the precise temperature inverting properties exhibited by the system are most likely a reflection of the response of the entire system to changes in temperature as opposed to the result of one particular component.

Depending upon the nature of materials desirably controlled through the utilization of a timing layer and the desired functional mode of the timing layer, the nature and permeability characteristics of a timing layer and the monomeric or polymerizable monomeric compounds thereof can be varied to suit particular applications. For instance, as stated earlier, a timing layer adapted to prevent the passage, or effect a "hold," of alkali for a predetermined period until the occurrence of a predetermined chemical reaction can assist in the control of environmental pH conditions in a photographic film unit. However, as is understood in the art, the presence in a timing layer of a polymer or other materials which adversely affect or negate the desired permeability properties of a timing layer is to be avoided.

As stated earlier, it is well known in the art that the development process generally becomes markedly faster at higher temperatures. Typically, timing layers have been designed so as to offer temperature responses substantially parallel to that of the development process, i.e., at elevated temperatures, the development process becomes markedly faster and the permeability of the timing layer to alkali is increased in order to minimize the side effects of temperature variations including premature or late interaction between the various components of the photographic system. However, as aforementioned U.S. Pat. No. 3,421,893 points out, at relatively high transfer processing temperatures, i.e., above approximately 27° C., a premature decrease in the pH of the transfer processing composition occurs due, at least in part, to the rapid diffusion of alkali from the dye transfer environment and its subsequent neutralization upon contact with the polymeric acid layer.

Therefore, while such timing layers have been found to provide advantageous results as are described in the above-mentioned patents; nevertheless, their performance in some photographic systems is not completely satisfactory, e.g., where it is desirable to develop photographic systems at hot temperatures, e.g., above approximately 27° C., there exists a need for "sieve-type" timing layers which exhibit temperature inverting properties, i.e., at higher temperatures, the development process becomes markedly faster and the permeability of the timing layer is decreased, to better control dye transfer resulting in desirable dye density.

Accordingly, as the state of the art for photographic systems advances, novel techniques and materials continue to be developed by those skilled in the art in order to attain the performance criteria required of such materials. There will always be a need for new timing layers that have advantages over those already known to the art; hence, investigations continue to be pursued to provide such advantages.

It has now been unexpectedly discovered that if a layer comprising a polyester urethane polymer(s) which is inert to alkali, i.e., does not become water-permeable, e.g., not permeable to an aqueous alkaline processing composition, in and of itself under typical film processing conditions, the layer exhibits permeability to alkali inversely dependent upon temperature and superior hot temperature processing performance, e.g., processing at a temperature above approximately 27° C., is achieved, as evidenced by higher transfer image maximum densities and the elimination of cracking in the finished photograph.

Accordingly, the present invention relates to a novel diffusion transfer film unit which includes a layer, e.g., a timing layer or a diffusion control interlayer, which exhibits permeability to alkali inversely dependent upon temperature, and specifically, to a layer comprising polyester urethane polymers which are inert to alkali unexpectedly resulting in superior hot temperature processing.

SUMMARY OF THE INVENTION

These and other objects and advantages are accomplished in accordance with the invention by providing a diffusion transfer film unit which includes a layer which exhibits permeability to alkali inversely dependent upon temperature, i.e., decreased permeability to alkali as the photographic film processing temperature is increased. The layer comprises from about 15% to about 50% by weight polyester urethane polymers which are inert to alkali and from about 50% to about 85% by weight other suitable polymeric materials. Preferably, the layer is a timing layer or a diffusion control interlayer; however, the diffusion transfer film unit may include two or more of the layers as, e.g., a timing layer and a diffusion control interlayer.

Development of an exposed photosensitive element of a diffusion transfer film unit generally takes place under alkaline conditions, e.g., pH 12–14, provided by, e.g., an aqueous alkaline processing composition. A neutralizing layer such as a nondiffusible acid-reacting reagent may be used in the film unit to lower the pH from this first (high) pH of the processing composition to a predetermined second (lower) pH. A timing layer may be positioned before the neutralization layer to ensure that the pH reduction occurs after a sufficient, predetermined period and not prematurely so as to interfere with the development process. Timing layers have been designed to operate in several ways including as sieves which slowly meter the flow of alkali therethrough ("sieve-type") and as alkali-impermeable barriers for predetermined time intervals before converting to alkali-permeable barriers ("hold and release").

The polyester urethane polymers are inert to alkali, i.e., do not become water-permeable, e.g., to an aqueous alkaline processing composition, in and of themselves, under photographic film processing conditions. In other words, in contrast to the polyurethane compounds employed in the "hold and release" timing layers and diffusion control interlayers described in the above-mentioned patents, those skilled in the art will recognize that there is no substantial degree of chemical reaction, e.g., hydrolysis or beta-elimination, of the polyester urethane polymers of the present invention under the typical photographic processing conditions encountered in diffusion transfer. Thus, in the embodiment of the present invention wherein the layer is a timing layer, the timing layer operates as a sieve as opposed to a "hold and release" timing layer described in the above-mentioned patents.

Further, since the polyester urethane polymers of the present invention do not convert to alkali-permeable compounds upon the infusion of the aqueous alkaline processing composition, the relative amounts of polyester urethane polymers and polymeric material are selected so as to permit suitable photographic development by the diffusion of the aqueous alkaline processing composition.

In another embodiment of the present invention, the layer may be a diffusion control interlayer, e.g., separating silver halide layers in a photosensitive element, permitting the passage of alkali for photographic development of emulsion layers while providing a measure of control over the passage of, e.g., image dye-providing materials. Hence, the transfer of, e.g., image dye-providing materials, is more clearly controlled by the silver halide emulsion with which each is associated thereby minimizing interimage effects, associated dye loss and deficiencies in color fidelity.

The layer of the present invention which exhibits permeability to alkali inversely dependent upon temperature may be used in conjunction with any photographic emulsion. Moreover, the layer may be used during the photographic processing of any exposed photosensitive element including photographic systems for forming images in black and white or in color and those wherein the final image is a metallic silver image or one formed by other image-forming materials, e.g., image dye-providing materials.

It has been found that the use of a diffusion transfer photographic film unit including a layer, e.g., a timing layer, exhibiting permeability to alkali inversely dependent upon temperature not only provides superior hot temperature processing as shown by the generation of an image which exhibits desirable dye densities but also eliminates undesirable cracking of the finished photograph.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The polyester urethane polymers which are suitable for use in the present invention are known compounds and as such may be prepared using techniques which are well known to those of skill in the art, e.g., see U.S. Pat. Nos. 4,108,814; 4,237,264; and 4,408,008.

In addition, suitable polyester urethane polymers are commercially available as a series of compounds under the tradename Bayhydrol from the Bayer Corporation (Pittsburgh, Pa.). The preferred compounds of the present invention are Bayhydrol PU-402A, Bayhydrol DLN and Bayhydrol AQ. However, any similar polyester urethane polymers incorporated into a layer which as a result of their inclusion exhibits the temperature inverting properties reported herein may also be utilized in the present invention.

Aforementioned U.S. Pat. No. 4,108,814 describes processes for preparing water-soluble polyurethanes and aqueous polyurethane dispersions. The processes described therein can be utilized to prepare the polyester urethane polymers of the present invention, e.g., forming a prepolymer by reacting sulphonate containing diols with polyisocyanates and polyesters and then, chain extending the prepolymer with water and water-soluble polyamines. It will be appreciated by those of ordinary skill in the art, however, that any suitable method for preparing the polyester urethane polymers used in the present invention may be utilized.

The polyester urethane polymers employed in the layer(s) of the present invention may be used in any amount which is required to accomplish their intended purpose, e.g., as a "sieve-type" timing layer or a diffusion control interlayer. It will be appreciated by those of ordinary skill in the art that the amount of polyester urethane polymer(s) necessary in any specific instance is dependent upon a number of factors such as, for example, the specific polyester urethane polymer(s) utilized, the type of diffusion transfer film unit and the result desired.

The polymeric material of the layer which exhibits permeability to alkali inversely dependent upon temperature can be any suitable polymeric material which does not adversely affect or negate the desired alkali permeability characteristics of the layer. Matrix polymer systems adapted to utilization in the layer of the present invention can be prepared by physical mixing of the matrix polymer and the polyester urethane polymer(s) of the invention, or by the preparation of the polyester urethane polymer(s) of the invention in the presence of a pre-formed matrix polymer.

Further, any suitable polymeric material may be used in the present invention; however, preferably, the matrix polymers will be copolymers which comprise comonomer units such as acrylic acid: methacrylic acid; methyl methacrylate; 2-acrylamido-2methylpropane sulfonic acid; acrylamide; methacrylamide; N,N-dimethyl acrylamide; ethyl acrylate; butyl acrylate; diacetone acrylamide; acrylamido acetamide; methacrylamido acetamide. A preferred polymeric material is a copolymer of diacetone acrylamide and acrylamide grafted onto polyvinyl alcohol.

In the production of the preferred copolymeric layer materials, and in the production of matrix polymers, the comonomeric units, as well as the ratios thereof, should be chosen on the basis of the physical characteristics desired in the matrix polymer and in the layer in which it is to be utilized. It will be understood, however, that the presence in the layer of polymer or other materials which adversely affect or negate the desired alkali permeability characteristics of the layer is to be avoided.

In this connection, it should be noted that gelatin, and particularly unhardened gelatin, is readily swollen and permeated by aqueous alkaline compositions typically employed in photographic processing. Accordingly, the presence in the layer of the invention of amounts of gelatin or other materials which promote rapid permeation of the layer by alkali and which effectively negate the permeability properties of the layer are to be avoided.

Further, in the embodiment of the present invention wherein the layer exhibiting permeability to alkali inversely dependent upon temperature is a timing layer, the timing layer is typically applied as a water-impermeable layer which results from the coalescence and drying of a coating composition, e.g., a latex composition.

The layer comprises from about 15% to about 50% by weight polyester urethane polymers which are inert to alkali and from about 50% to about 85% by weight other suitable polymeric materials. Preferred weight ratios of suitable polymeric materials to polyester urethane polymers are from about 2:1 to about 5:1.

A particularly preferred weight ratio of suitable polymeric materials to polyester urethane polymers is about 3:1. For example, for the diffusion transfer film unit described in Example I herein, the timing layer of the "test" diffusion transfer photographic film unit comprises about 4075.5 $mg/m^2$ of a copolymer of diacetone acrylamide and acrylamide grafted onto polyvinyl alcohol and about 1293.3 $mg/m^2$ of polyester urethane polymer. However, it will be appreciated by one of ordinary skill in the art that routine scoping tests may be conducted to ascertain the concentrations of polyester urethane polymer(s) and polymeric material which are appropriate for any given photographic element.

There are provided according to the present invention diffusion transfer photographic film units. In one embodiment, the polyester urethane polymer(s) is preferably incorporated in a timing layer of the image-receiving element of the diffusion transfer film unit. However, as mentioned earlier, the polyester urethane polymer(s) of the invention may be incorporated in other locations in the diffusion transfer film units such as, for example, in the photosensitive element as a diffusion control interlayer(s). Furthermore, the same and/or a different polyester urethane polymer can be used simultaneously in the, e.g., timing layer or diffusion control interlayer, and/or in various locations in the image-recording elements of the invention.

The layer(s) of the present invention which exhibits permeability to alkali inversely dependent upon temperature may be used during the photographic processing of any exposed photosensitive element including photographic systems for forming images in black and white or in color and those wherein the final image is a metallic silver image or one formed by other image-forming materials.

Image-recording elements useful in both black and white and color photographic imaging systems are well known in the art and, therefore, extensive discussion of such materials is not necessary. It should be noted, however, that although the diffusion transfer film unit of the present invention is preferably used in photographic systems which include a rupturable container or "pod," as is known in the art, which releasably contains an aqueous alkaline processing composition; nonetheless, the diffusion transfer film unit of the present invention may also be used in photographic systems which do not utilize a pod.

In addition, the layer of the present invention may be used in conjunction with any photographic emulsion. In the preferred diffusion transfer film units of the invention, it is preferred to include a negative working silver halide emulsion, i.e., one which develops in the areas of exposure. Further, the layers of the invention may be used in association with any image dye-providing materials, for example, complete dyes or dye intermediates, e.g., color couplers, or dye-developers. The dye developers contain, in the same molecule, both the chromophoric system of a dye and a silver halide developing function as is described in U.S. Pat. No. 2,983,606.

In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffusible imagewise as a function of development or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in the multicolor diffusion transfer film units of the present invention.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550. In a particularly preferred embodiment of the invention the image dye-providing materials are dye-developers which are initially diffusible materials.

Aforementioned U.S. Pat. No. 3,719,489 and U.S. Pat. No. 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

A technique which utilizes two different imaging mechanisms, namely dye developers and image dye-releasing thiazolidines, is described and claimed in U.S. Pat. No. 4,740,448. According to this process the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine. Particularly preferred diffusion transfer film units according to the present invention include, as image dye-providing materials, both dye developers and dye-providing thiazolidine compounds as described in aforementioned U.S. Pat. No. 4,740,448 and, as shown in Example I herein.

The diffusion transfer photographic systems utilizing the diffusion transfer film units of the present invention may include any of the known diffusion transfer multicolor films. Particularly preferred diffusion transfer photographic film units according to the invention are those intended to provide multicolor dye images. The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively.

Suitable photosensitive elements and their use in the processing of diffusion transfer photographic images are well known and are disclosed, for example, in aforementioned U.S. Pat. No. 2,983,606; and in U.S. Pat. Nos. 3,345,163 and 4,322,489.

Aforementioned U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone. Commercial diffusion transfer photographic films of Polaroid Corporation including Polacolor SX-70, Time Zero and 600 have used cyan, magenta, and yellow dye developers.

The diffusion transfer photographic materials of the present invention include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the negative and positive components are retained together in an integral structure. In either case, after development the two elements may be retained together in a single film unit, i.e., an integral negative-positive film unit, or, preferably, they can be peeled apart from one another.

As stated above, the multicolor diffusion transfer photographic film units of the invention include those where the photosensitive element and the image-receiving element are maintained in superposed relationship before, during and after exposure as described in aforementioned U.S. Pat. No. 3,415,644. In commercial embodiments of this type of film (e.g. SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers.

In a film unit of the type described in aforementioned U.S. Pat. No. 3,415,644 and, as shown in Example I herein, the red sandwich or image component is positioned closest to the support for the photosensitive element, and the blue image component is positioned the farthest from said support and closest to the image-receiving layer.

In a film unit of the type described in U.S. Pat. No. 3,594,165, the red image component is closest to the support for the photosensitive element, and it also is the closest to the image-receiving layer since said layer is carried by the same support. Accordingly, the blue image component is most distant from said support and from the image-receiving layer.

As stated earlier, the present invention may be practiced with any multicolor diffusion transfer photographic film units and these film units may include any image dye-providing materials. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer.

Briefly, for example, a preferred embodiment of a photographic diffusion transfer film unit wherein the image-receiving element is designed to be separated from the photosensitive element after exposure and photographic processing typically includes: (1) a photosensitive element comprising a support carrying at least one silver halide emulsion layer; (2) a second sheet-like element which is superposed or superposable on said photosensitive element; (3) an image-receiving layer positioned in one of said photosensitive or second sheet-like elements; (4) a rupturable container releasably holding an aqueous alkaline processing composition and so positioned as to be adapted to distribute said processing composition between predetermined layers of said elements, and (5) a layer comprising a polyester urethane polymer(s) and suitable polymeric material according to the invention. Further, the photosensitive element preferably includes an image dye-providing material in association with said silver halide emulsion layer(s). Moreover, the photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

Furthermore, the preferred image-receiving element mentioned above comprises a support carrying a polymeric acid-reacting layer and an image-bearing layer. Each of the layers carried by the support functions in a predetermined manner to provide desired diffusion transfer photographic processing as is known in the art. It should also be understood that the image-receiving layer may include additional layers such as a strip-coat layer, e.g., as disclosed and claimed in U.S. Pat. No. 5,346,800, and an overcoat layer, e.g., as disclosed and claimed in U.S. Pat. No. 5,415,969, and as is known in the art. The image-receiving elements of the present invention preferably include a strip-coat layer as disclosed and claimed in aforementioned U.S. Pat. No. 5,346,800.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material.

While the support material of the image-receiving element shown in Example I herein will preferably be an opaque material for production of a photographic reflection print, it will be appreciated that support will be a transparent support material where the processing of a photographic transparency is desired. In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency. In another embodiment where support material is a transparent sheet, opacification materials such as carbon black and titanium dioxide can be incorporated in the processing composition to permit in-light development.

As mentioned above, the preferred film unit includes a pressure-rupturable container. Such pods and like structures are common in the art and generally define the means for providing the processing composition to the photosensitive element and image-receiving element. The processing composition typically comprises an aqueous alkaline composition which may include a silver halide developing agent and other addenda as is known in the art. Examples of such processing compositions are found in U.S. Pat. Nos. 3,445,685; 3,597,197; 4,680,247; 4,756,996 and 5,422,233, as well as the patents cited therein.

In addition, the aqueous alkaline processing composition utilized in the diffusion transfer film units of the invention may include one or more of the acylpyridine-N-oxide compounds as disclosed and claimed in copending, commonly-assigned U.S. patent application Ser. No. 08/648,203 (Case No. 8104), filed on even date herewith by Michael P. Filosa, Edward D. Kingsley and Kenneth C. Waterman.

The photosensitive system referred to above comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-receiving layer as a function of exposure. As described previously, preferred photographic diffusion transfer film units are intended to provide multicolor dye images and the photosensitive element is preferably one capable of providing such multicolor dye images. In a preferred black and white embodiment, the image-forming material utilized is complexed silver which diffuses from the photosensitive element to the image-receiving layer during processing. Moreover, the image-receiving layer utilized in such black and white embodiments typically includes silver nucleation materials. As stated earlier, both such photosensitive systems are well known in the art.

Briefly, however, in the black and white diffusion transfer film units of the present invention, a photosensitive element including a photosensitive silver halide emulsion is exposed to light and subjected to an aqueous alkaline solution comprising a silver halide developing agent and a silver halide solvent. The developing agent reduces exposed silver halide to an insoluble form and the unexposed silver halide, solubilized by the silver solvent, migrates to an image-receiving element. The image-receiving element of these film units typically comprises a support and an image-receiving layer including a silver precipitating material such as that referred to above wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991 and 3,607,269 and in E. H. Land, H. G. Rogers, and V. K. Walworth, in J. M. Sturge, ed., *Neblette's Handbook of Photography and Reprography,* 7th ed., Van Nostrand Reinhold, New York, 1977, pp. 258–330.

As mentioned previously, preferably, the image-receiving element of the invention includes a polymeric acid-reacting layer. The polymeric acid-reacting layer reduces the environmental pH of the film unit, subsequent to transfer image formation. As disclosed, for example, in aforementioned U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; poly-acrylic acid; polystyrene sulfonic acid; and maleic anhydride copolymers and half esters thereof.

Further, a polymeric acid-reacting layer can be applied, if desired, by coating the support layer with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in U.S. Pat. Nos. 3,765,885; 3,819,371; 3,833,367 and 3,754,910.

As mentioned earlier, the image-receiving layer of the invention is designed for receiving an image-forming material which diffuses in an imagewise manner from the photosensitive element during processing. In color embodiments of the present invention, the image-receiving layer generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061.

Another image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346. Other suitable materials can, however, be employed.

For example, suitable mordant materials of the vinylbenzyltrialkylammonium type are described, for example, in U.S. Pat. No. 3,770,439. Mordant polymers of the hydrazinium type (such as polymeric mordants prepared by quaternization of polyvinylbenzyl chloride with a disubstituted asymmetric hydrazine), e.g., those described in Great Britain Pat. No. 1,022,207, published Mar. 9, 1966, can also be employed. One such hydrazinium mordant is poly(1-vinylbenzyl 1,1-dimethylhydrazinium chloride) which, for example, can be admixed with polyvinyl alcohol for provision of a suitable image-receiving layer.

As noted previously, the image-receiving elements of the invention preferably include other layers such as a strip-coat layer which is designed to facilitate the separation of the image-receiving element from the photosensitive element. Many materials have been disclosed in the art for use in strip-coat layers. Typical suitable strip-coat materials are described in U.S. Pat. Nos. 4,009,031 and aforementioned 5,346,800.

As stated earlier, the image-receiving element of the invention may also include an overcoat layer as described in aforementioned U.S. Pat. No. 5,415,969 and copending, commonly-assigned continuation-in-part application Ser. No. 08/382,880, filed Feb. 2, 1995, wherein water-insoluble particles are provided in a binder material. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 mm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to the image-receiving layer to provide a photograph of the desired quality. Furthermore, since the overcoat layer(s) remains upon the image-receiving element after processing and separation from the photosensitive element, the overcoat layer(s) should not scatter visible light to any appreciable degree since the photograph will be viewed through such layer(s).

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Temperature Inverting Properties of a Timing Layer Prepared According to the Invention Three diffusion transfer photographic film units of each of two different types were prepared: (type 1) three "test" film units, i.e., film units prepared according to the invention, and (type 2) three "control" film units, i.e., film units prepared according to the invention but for the inclusion of the polyester urethane polymer(s) in the timing layer. More specifically, as will be described in detail below, the image-receiving elements of the "test" film units prepared according to the invention included a polyester urethane polymer, purchased from the Bayer Corporation under the tradename Bayhydrol PU-402A, in the timing layer.

The photosensitive elements used in all of the photographic film units described above comprised an opaque subcoated polyethylene terephthalate photographic film base carrying in succession:

1. a cyan dye developer layer comprising about 807 mg/m$^2$ of the cyan dye developer represented by the formula

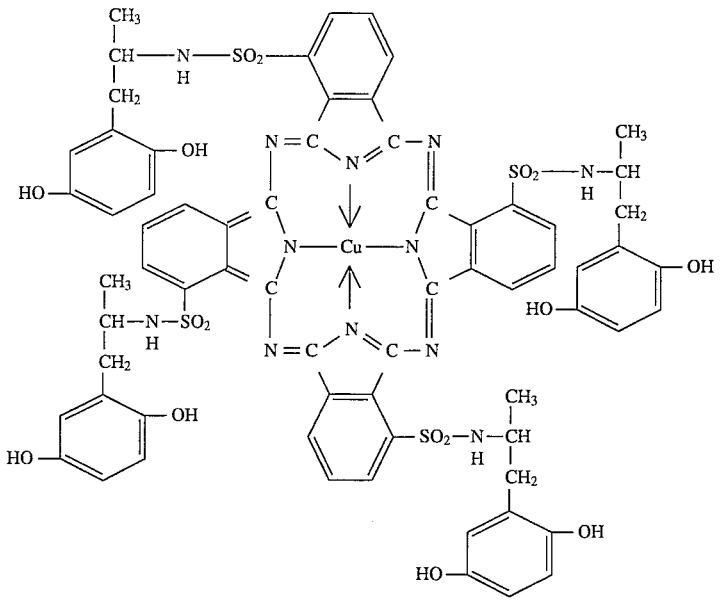

about 448 mg/m$^2$ of gelatin, about 15 mg/m$^2$ of zinc bis (6-methylaminopurine) and about 120 mg/m$^2$ of bis-2,3-(acetamidomethylnorbornyl) hydroquinone ("AMNHQ");

2. a red-sensitive silver iodobromide layer comprising about 224 mg/m$^2$ of silver iodobromide (0.7 μm), about 785 mg/m$^2$ of silver iodobromide (1.5 μm), about 112 mg/m$^2$ of silver iodobromide (1.8 μm) and about 561 mg/m$^2$ of gelatin;

3. an interlayer comprising about 2325 mg/m$^2$ of a copolymer of butyl acrylate/diacetone acrylamide/methacrylic acid/styrene/acrylic acid, about 97 mg/m$^2$ of polyacrylamide, about 124 mg/m$^2$ of N-hydroxymethyldimethylhydantoin and about 3 mg/m$^2$ of succindialdehyde;

4. a magenta dye developer layer comprising about 374 mg/m$^2$ of a magenta dye developer represented by the formula

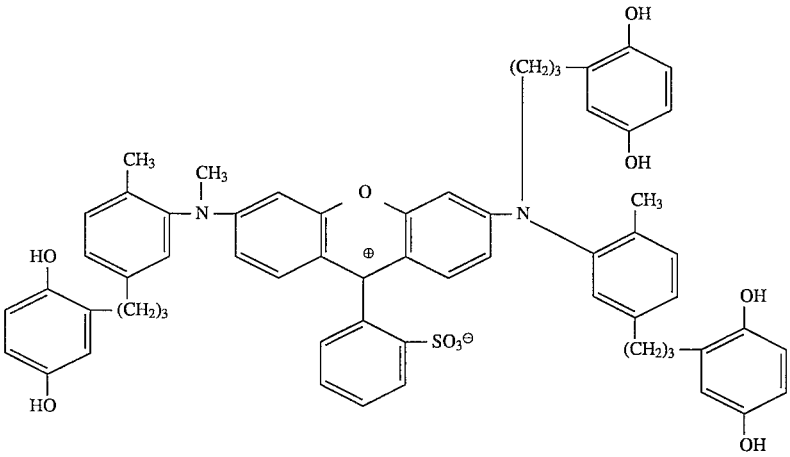

about 400 mg/m$^2$ of 2-phenyl benzimidazole, about 20 mg/m$^2$ of a cyan filter dye, about 75 mg/m$^2$ of 3-acetylpyridine-N-oxide and about 248 mg/m$^2$ of gelatin;

5. a spacer layer comprising about 250 mg/m$^2$ of carboxylated styrenebutadiene latex (Dow 620 latex) and about 83 mg/m$^2$ of gelatin;

6. a green-sensitive silver iodobromide layer comprising about 236 mg/m$^2$ of silver iodobromide (0.6 μm), about 33 mg/m$^2$ of silver iodobromide (1.1 μm), about 378 mg/m$^2$ of silver iodobromide (1.3 μm) and about 437 mg/m$^2$ of gelatin;

7. a layer comprising about 100 mg/m$^2$ AMNHQ, about 20 mg/m$^2$ of bis (6-methylaminopurine), about 75 mg/m$^2$ of 6-hydroxy-4,4-5,7,8-pentamethyl-3,4-dihydrocoumarin and about 73 mg/m$^2$ of gelatin;

8. an interlayer comprising about 1448 mg/m$^2$ of the copolymer described in layer 3 and about 76 mg/m$^2$ of polyacrylamide;

9. a layer comprising about 100 mg/m$^2$ of a scavenger, 1-octadecyl-4,4-dimethyl-2-[2-hydroxy-5-(N-(7-caprolactamido)sulfonamido-phenyl]thiazolidine, about 20 mg/m$^2$ of a magenta filter dye and about 440 mg/m$^2$ of gelatin;

10. a yellow filter layer comprising about 280 mg/m$^2$ of a benzidine yellow dye and about 105 mg/m$^2$ of gelatin;

11. a yellow image dye-providing layer comprising about 910 mg/m$^2$ of a yellow image dye-providing material represented by the formula

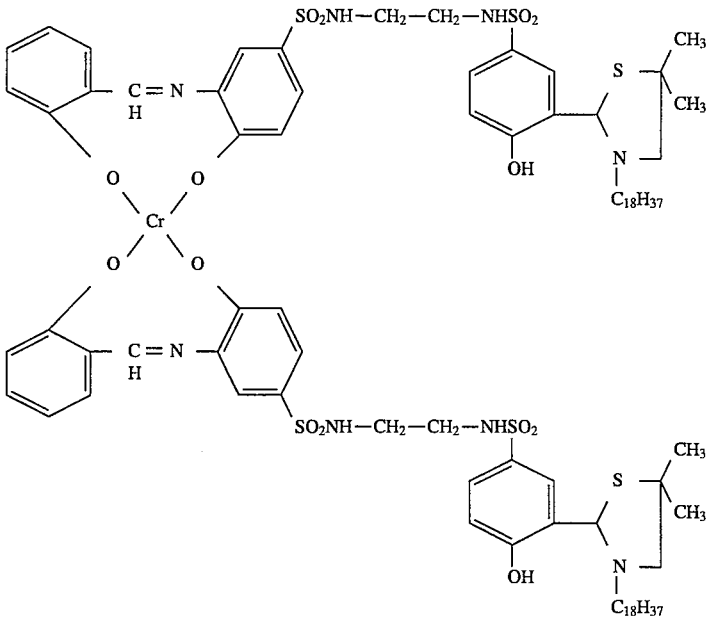

and about 364 mg/m$^2$ of gelatin;

12. a layer coated at a coverage of about 850 mg/m$^2$ of a hydrogen-bonded complex of norbornyltertiarybutyl hydroquinone (NTBHQ) and dimethylterephthalamide (DMPTA) and about 350 mg/m$^2$ of gelatin;

13. a blue-sensitive silver iodobromide layer comprising about 81 mg/m$^2$ of silver iodobromide (1.2 μm), about 189 mg/m$^2$ of silver iodobromide (2.0 μm) and about 135 mg/m$^2$ of gelatin; and 14. a layer comprising about 400 mg/m$^2$ of an ultraviolet filter material, Tinuvin (Ciba-Geigy), about 200 mg/m$^2$ ditertiarybutyl hydroquinone (DTBHQ), about 50 mg/m$^2$ of a releasable antifoggant

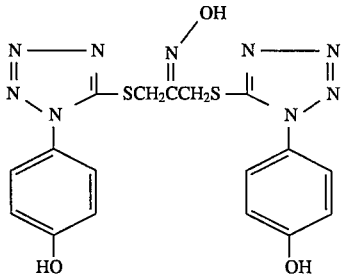

about 80 mg/m$^2$ of a benzidine yellow filter dye and about 73 mg/m$^2$ of gelatin.

Diffusion transfer photographic film units which can include the 3-acetylpyridine-N-oxide compound in layer 4 above are described and claimed in aforementioned copending, commonly-assigned U.S. patent application Ser. No. 08/648,203 (Case No. 8104), filed on even date herewith.

The image-receiving elements used in the "control" photographic film units comprised a white-pigmented polyethylene-coated opaque photographic film support having coated thereon in succession:

1. a polymeric acid-reacting layer coated at a coverage of about 24,212 mg/m$^2$ comprising a 1.2/1 ratio of AIRFLEX™ 465 (a vinyl acetate ethylene latex from Air Products Co.) and GANTREZ™ S-97 (a free acid of a copolymer of methyl vinyl ether and maleic anhydride from GAF Corp.);

2. a timing layer coated at a coverage of about 4075.5 mg/m$^2$ comprising 4026.6 mg/m$^2$ of a copolymer of diacetone acrylamide and acrylamide grafted onto polyvinyl alcohol and 48.9 mg/m$^2$ of aerosol-OS;

3. an image-receiving layer coated at a coverage of about 3228 mg/m$^2$ comprising 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part AIRVOL™ 425 (a fully hydrolyzed polyvinyl alcohol from Air Products Co.); and 4. a strip coat layer coated at a coverage of about 161 mg/m$^2$ comprising about 40% by weight of a terpolymer of acrylic acid, hydroxypropyl methacrylate and 4-vinylpyrrolidone and about 60% by weight of carboxymethyl guar.

The image-receiving elements utilized in the "test" diffusion transfer photographic film units were the same as described above except that layer 2 was a timing layer coated at a coverage of about 5434 mg/m$^2$ comprising 4075.5 mg/m$^2$ of a copolymer of diacetone acrylamide and acrylamide grafted onto polyvinyl alcohol, 1293.3 mg/m$^2$ of Bayhydrol PU-402A (Bayer) and 65.2 mg/m$^2$ of aerosol-OS.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of the film units is set forth in Table I.

TABLE I

| COMPONENT | PARTS BY WEIGHT |
|---|---|
| hypoxanthine | 0.98 |
| 1-methylimidazole | 0.29 |
| guanine | 0.15 |
| potassium hydroxide | 8.55 |
| p-hydroxyphenylmercaptotetrazole | 0.005 |
| bis-6-methylaminopurine | 0.03 |
| titanium dioxide | 0.20 |
| 6-methyluracil | 0.54 |
| pentanolamine | 1.96 |
| hydrophobically modified HEC | 3.36 |
| 1,2,4-triazole | 0.35 |
| phenylmercaptotetrazole | 0.004 |
| 2,3-cyclohexeno-1-ethylpyridinium tosylate | 2.40 |
| water | Balance to 100 |

Each film unit, after exposure to a sensitometric target, was passed through a pair of rollers set at a gap spacing of about 0.0030 inch (0.0762 mm) and after an imbibition period of either 45, 60, 90, 120 or 180 seconds at a temperature of either 27°, 35° or 40° C., the image-receiving element was separated from the remainder of the film unit to reveal the image.

The red maximum ($D_{max}$) reflection densities which were read on a MacBeth Densitometer are shown in Tables II, III and IV below.

TABLE II

| 27° C. | 45 sec | 60 sec | 90 sec | 120 sec | 180 sec |
|---|---|---|---|---|---|
| FILM UNIT | $D_{max}$ | $D_{max}$ | $D_{max}$ | $D_{max}$ | $D_{max}$ |
| Control | 1.26 | 1.48 | 1.77 | 2.03 | 2.08 |
| Test | 1.25 | 1.46 | 1.75 | 2.02 | 2.08 |

TABLE III

| 35° C. | 45 sec | 60 sec | 90 sec | 120 sec | 180 sec |
|---|---|---|---|---|---|
| FILM UNIT | $D_{max}$ | $D_{max}$ | $D_{max}$ | $D_{max}$ | $D_{max}$ |
| Control | 1.24 | 1.42 | 1.66 | 1.80 | 1.90 |
| Test | 1.25 | 1.46 | 1.74 | 2.00 | 2.06 |

TABLE IV

| 40° C. | 45 sec | 60 sec | 90 sec | 120 sec | 180 sec |
|---|---|---|---|---|---|
| FILM UNIT | $D_{max}$ | $D_{max}$ | $D_{max}$ | $D_{max}$ | $D_{max}$ |
| Control | 1.21 | 1.40 | 1.56 | 1.61 | 1.63 |
| Test | 1.25 | 1.42 | 1.68 | 1.91 | 2.00 |

It can be seen from the red $D_{max}$ values in Tables II–IV that the image-receiving elements according to the invention allowed sufficient image dye-providing materials to diffuse to the image-receiving layer to provide an acceptable photograph.

It can also be seen from the red $D_{max}$ values in Tables III–IV that the use of a timing layer according to the present invention, i.e., in a "test" photographic film unit, allowed sufficient image dye-providing materials to diffuse to the image-receiving layer to provide an acceptable photograph as the processing temperature was increased.

By contrast, it can be seen that the "control" photographic film units tended to acquire less density with time as the processing temperature was increased. This result may be due, in part, to a premature decrease in the pH of the transfer processing composition because of the more rapid diffusion of alkali from the dye transfer environment and its subsequent neutralization upon contact with the polymeric acid layer.

In addition to the beneficial effects described above, the use of a timing layer according to the present invention, i.e., in a "test" photographic film unit, eliminated cracking in the finished photograph. The elimination of cracking in the finished photograph was likely due, in part, to the low glass transition temperature ($T_g$) of the polyester urethane polymer of the invention.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A diffusion transfer photographic film unit which comprises:

a support;

a polymeric acid-reacting layer;

at least one silver halide emulsion layer;

an image-receiving layer; and a layer exhibiting temperature inverting properties and comprising from about 15% to about 50% by weight of a polyester urethane polymer which is inert to alkali and from about 50% to about 85% by weight of a second polymeric material.

2. A diffusion transfer photographic film unit according to claim 1 wherein the weight ratio of said second polymeric material to said polyester urethane polymer is from about 2:1 to about 5:1.

3. A diffusion transfer photographic film unit according to claim 1 wherein the weight ratio of said second polymeric material to said polyester urethane polymer is about 3:1.

4. A diffusion transfer photographic film unit according to claim 1 wherein said second polymeric material comprises a copolymer of diacetone acrylamide and acrylamide grafted onto polyvinyl alcohol.

5. A diffusion transfer photographic film unit according to claim 1 wherein said polymeric acid-reacting layer comprises a vinyl acetate ethylene latex and a free acid of a copolymer of methylvinylether and maleic anhydride.

6. A diffusion transfer photographic film unit according to claim 1 wherein said image-receiving layer comprises a graft terpolymer of vinylbenzyltrimethylammonium chloride, vinylbenzyltriethylammonium chloride and vinylbenzyldimethyldodecylammonium chloride grafted onto polyvinyl alcohol.

7. A diffusion transfer photographic film unit according to claim 1 further including a reducing agent and wherein said image-receiving layer comprises silver precipitating nuclei.

8. A diffusion transfer photographic film unit according to claim 1 further including an image dye-providing material in association with said silver halide emulsion layer.

9. A diffusion transfer photographic film unit according to claim 8 which comprises a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

10. A diffusion transfer photographic film unit according to claim 9 wherein said yellow image dye-providing material is an image dye-releasing thiazolidine and each of said cyan and magenta image dye-providing materials is a dye developer.

11. A diffusion transfer photographic film unit according to claim 1 further including a means providing an aqueous alkaline processing composition.

12. A diffusion transfer photographic film according to claim 11 wherein said means providing an aqueous alkaline processing composition is a rupturable container releasably holding said aqueous alkaline processing composition.

13. A diffusion transfer photographic film unit comprising:

a photosensitive element comprising a support carrying at least one silver halide emulsion layer in association with an image dye-providing material;

an image-receiving element comprising a support carrying a polymeric acid-reacting layer, a timing layer residing on said polymeric acid-reacting layer, said timing layer exhibiting temperature inverting properties and comprising from about 15% to about 50% by weight of a polyester urethane polymer which is inert to alkali and from about 50% to about 85% by weight of a second polymeric material, said image-receiving element superposed or superposable on said photosensitive element;

an image-receiving layer; and means providing an aqueous alkaline processing composition for initiating development of said silver halide emulsion after photoexposure to form an image on said image-receiving layer.

14. A diffusion transfer photographic film unit according to claim 13 wherein the weight ratio of said second polymeric material to said polyester urethane polymer is from about 2:1 to about 5:1.

15. A diffusion transfer photographic film unit according to claim 13 wherein the weight ratio of said second polymeric material to said polyester urethane polymer is about 3:1.

16. A diffusion transfer photographic film unit according to claim 13 wherein said second polymeric material comprises a copolymer of diacetone acrylamide and acrylamide grafted onto polyvinyl alcohol.

17. A diffusion transfer photographic film unit according to claim 13 wherein said polymeric acid-reacting layer comprises a vinyl acetate ethylene latex and a free acid of a copolymer of methylvinylether and maleic anhydride.

18. A diffusion transfer photographic film unit according to claim 13 wherein said image-receiving layer comprises a graft terpolymer of vinylbenzyltrimethylammonium chloride, vinylbenzyltriethylammonium chloride and vinylbenzyldimethyldodecylammonium chloride grafted onto polyvinyl alcohol.

19. A diffusion transfer photographic film unit according to claim 13 wherein said photosensitive element comprises a support carrying a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

20. A diffusion transfer photographic film unit according to claim 19 wherein said yellow image dye-providing material is an image dye-releasing thiazolidine and each of said cyan and magenta image dye-providing materials is a dye developer.

21. A diffusion transfer photographic film unit according to claim 13 wherein said means providing an aqueous alkaline processing composition is a rupturable container releasably holding said aqueous alkaline processing composition.

22. A diffusion transfer photographic film unit according to claim 13 further including a strip-coat overlying said image-receiving layer and wherein said photosensitive element and said image-receiving element are initially arranged in superposable relationship.

* * * * *